US005444899A

United States Patent [19]

Koppelomäki

[11] Patent Number: 5,444,899

[45] Date of Patent: Aug. 29, 1995

[54] SAFETY CATCH

[75] Inventor: Leo Koppelomäki, Reftele, Sweden

[73] Assignee: Lars Brandel, Falkenberg, Sweden

[21] Appl. No.: 137,185

[22] PCT Filed: Apr. 27, 1992

[86] PCT No.: PCT/SE92/00274

§ 371 Date: Apr. 28, 1994

§ 102(e) Date: Apr. 28, 1994

[87] PCT Pub. No.: WO92/19118

PCT Pub. Date: Nov. 12, 1992

[30] Foreign Application Priority Data

Apr. 30, 1991 [SE] Sweden ..... 9101364

[51] Int. Cl.[6] ..... A44B 11/00

[52] U.S. Cl. ..... 24/625; 24/615; 24/635

[58] Field of Search ..... 24/625, 635, 615, 616, 24/313

[56] References Cited

U.S. PATENT DOCUMENTS

| | | | |
|---|---|---|---|
| 3,585,692 | 6/1971 | Le Mire | 24/635 |
| 4,012,155 | 3/1977 | Morris | 24/625 |
| 4,559,679 | 12/1985 | Downey | 24/615 |
| 4,694,544 | 9/1987 | Chapman | 24/625 |

FOREIGN PATENT DOCUMENTS

| | | |
|---|---|---|
| 20363121 | 4/1990 | European Pat. Off. . |
| 12526646 | 11/1983 | France . |
| 2145767 | 4/1985 | United Kingdom . |

*Primary Examiner*—Victor N. Sakran
*Attorney, Agent, or Firm*—Ladas & Parry

[57] ABSTRACT

A yieldable safety connection including a male portion (20) insertable into a female portion (30) for separation therefrom when both portions are subjected to counter-directed traction forces exceeding a certain magnitude. The male portion (20) includes a fork-like device (40) including a first arm (21) and a second arm (22), while the female portion (30) includes a first material portion (31) and a second material portion (32) between which the fork-like device of the male portion is located when the male portion has been inserted in the female portion. Both arms of the male portion and both material portions of the female portion are provided with locking devices (23, 24; and 33, 34, respectively), which are provided with abutment surfaces (43, 44 and 73, 74 respectively) oriented at an oblique angle in relation to the major direction of the traction forces. When the traction forces are applied, reaction forces are produced at right angles to the major direction of the traction forces, whereupon the cooperating locking devices (23, 24 and 33, 34, respectively) are resiliently displaced form one another and the male portion is withdrawn from the female portion when the traction forces exceed certain magnitude.

6 Claims, 5 Drawing Sheets

SAFETY CATCH

FIELD OF THE INVENTION

The present invention relates to e safety catch interconnecting two separate parts preamble of appended Claim 1.

BACKGROUND

There are needs in many contexts for a safety catch for interconnecting two parts, in which the safety catch, on being subjected to counter-directed traction forces exceeding a given magnitude, breaks the interconnection between the two parts and thereby releases the interconnected parts from one another. Such needs are particularly accentuated in practical applications in which there may be the risk of injury, for example personal injury, if the forces involved become excessively large. Such may, for instance, be the case in connection with sport and freetime activities such as, for example, skiing. There is also a need in buckles for children's safety helmets, that the buckles disengage if the traction forces in the straps retaining the helmet on the child's head become excessive. Accidents have occurred because children wearing such safety helmets while playing in, for example, trees have become trapped by the helmet between two branches of a tree, been unable to escape by their own efforts and consequently been strangled.

There are also needs to be able, in the buckles employed for safety helmets to adjust that force at which the parts interconnected by the buckle are released from one another. In, for instance, children's helmets, such release force may thereby be adapted to meet relevant requirements, and the helmet be thus rendered usable and operate with completely adequate function irrespective of the weight of the child.

SUMMARY OF THE INVENTION

The present invention provides to an arrangement in which the above-outlined needs are satisfied. This is attained by a yieldable safety connection in which a male portion is inserted into a female portion for separation when both portions are subjected to counter-directed tractive forces exceeding a certain magnitude. The male portion includes a fork-like device having first and second arms, while the female portion includes first and second material portions between which the fork-like device of the male portion is located when the male portion has been inserted in the female portion. Both arms of the male portion and both material portions of the female portion are provided with locking devices, which have abutment surfaces oriented at an oblique angle in relation to the direction of the tractive forces. When the tractive forces are applied, reaction forces are produced at right angles to the direction of the tractive forces, whereupon the cooperating locking devices are resiliently displaced from one another and when the tractive force reaches a predetermined limit the male portion is withdrawn from the female portion. A support body is disposed between the arms of the fork-like device to prevent the arms from being displaced towards one another, the support body being adjustable lengthwise along the arms.

BRIEF DESCRIPTION OF THE DRAWINGS

The present invention will be described in greater detail hereinbelow, with particular reference to a number of Drawings. In the accompanying Drawings.

DETAILED DESCRIPTION

Figure 1:
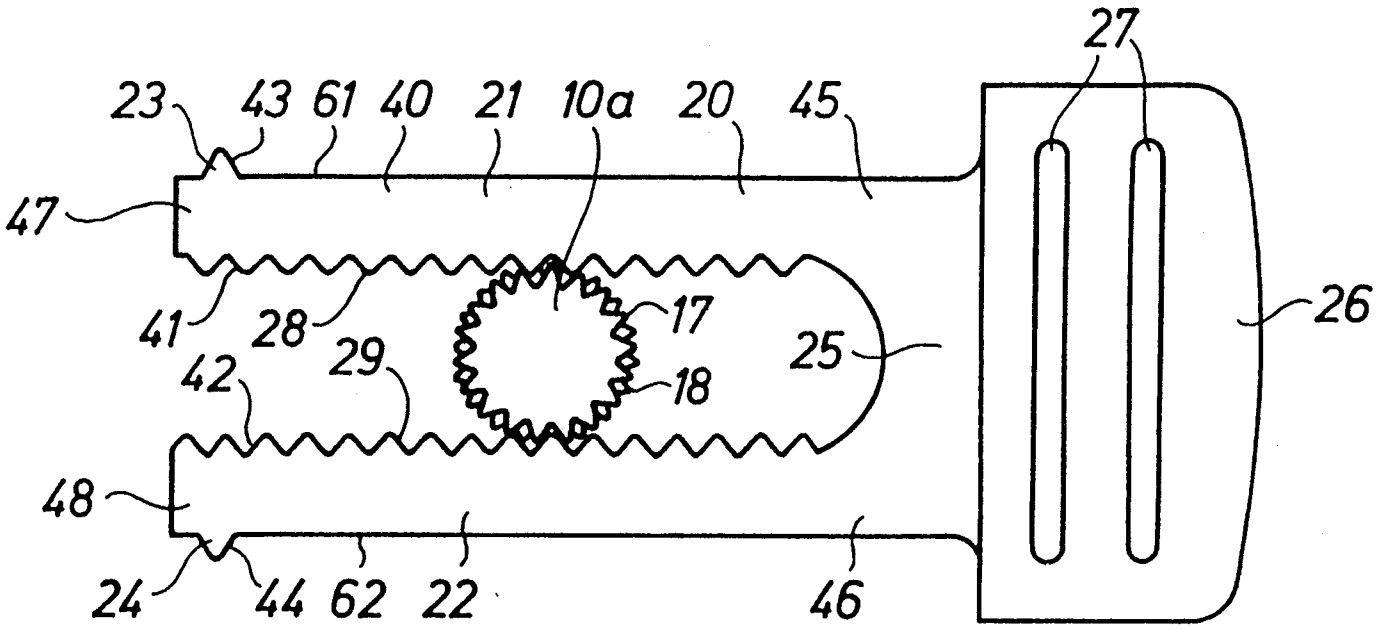
FIG. 1 is a top plan view of the male portion of a safety catch comprising a male portion and a female portion.
Figure 2:
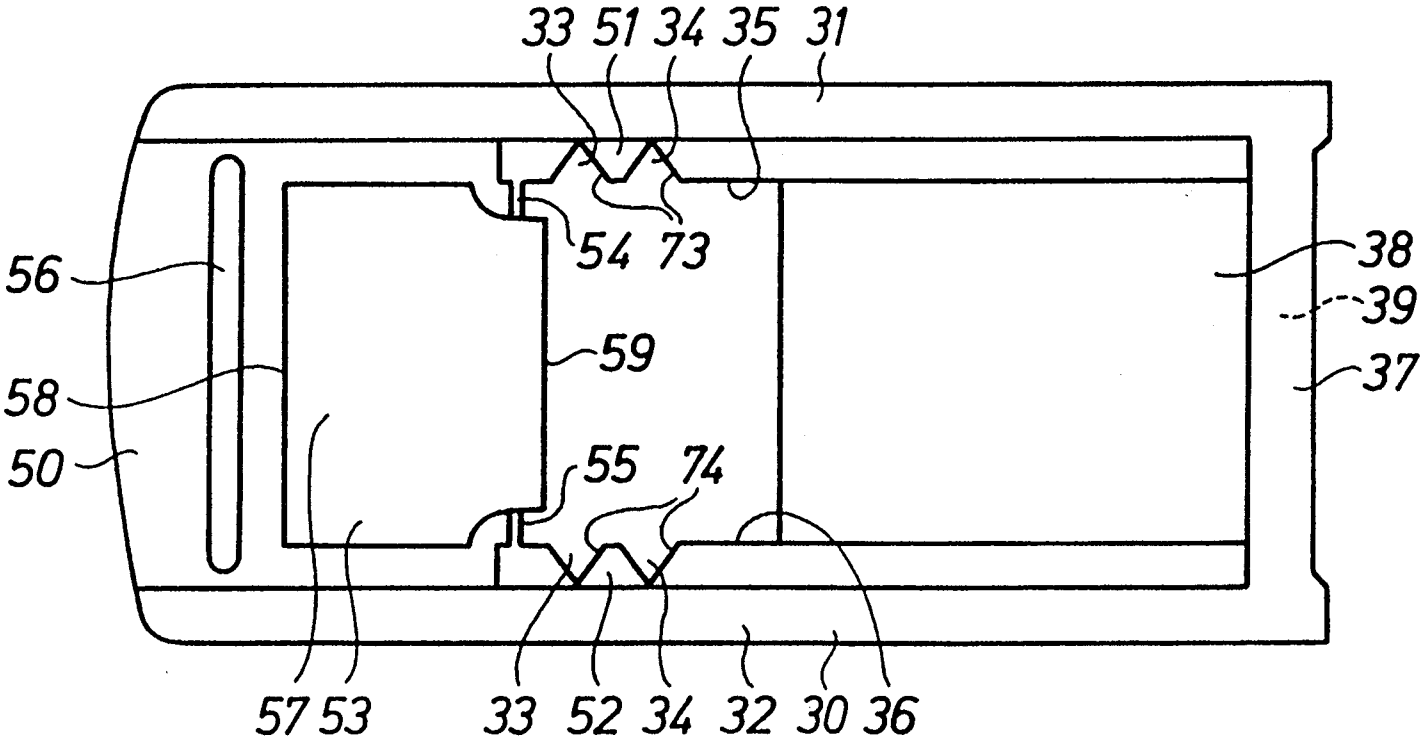
FIG. 2 is a top plan view of the female portion of the safety catch.

The embodiments of the present invention shown in the Drawings include a male portion 20 and a female portion 30. The male portion consists of a fork-like device 40 with a first arm 21 and a second arm 22 which, at their one end regions 45 and 46, are connected to a web portion 25 and, at their other, outer end regions 47, 48 form the free ends of the fork-like device. In the illustrated embodiments, the web portion is connected to a strap fastener 26 provided with openings 27 in which a strap (not shown on the Drawings) connected to the male portion is intended to be inserted. It will be obvious to a person skilled in the art that the connection between the strap and the male portion may be of other design in other embodiments.

Each one of the arms 21, 22 is, at its free end regions 47, 48 provided with at least one locking device (snap device) 23.24 which is located on the outer lateral surfaces 61, 62 of the arms facing away from one another. In the Figures, the locking devices are shown as projecting material portions which, in a direction towards the web portion 25, are defined by surfaces 43.44 obliquely inclined in relation thereto. In the illustrated embodiment, the material portions are V-shaped. In alternative embodiments the locking devices are provided in the form of recesses which also display obliquely inclined defining surfaces in relation to the longitudinal direction of the fork.

In one preferred embodiment, the mutually facing inner lateral surfaces 41, 42 of the arms are provided with fixing devices 28, 29 generally of the configuration of a gear rack and designed to cooperate with a central body 10, 10*a* also provided with fixing devices 13, 14; 17.18 for cooperation with the fixing devices 28. 29 of the inner lateral surfaces. The dimensions of the central body and the space between the inner lateral surfaces of the arms are adapted to one another such that, with the central body inserted between the inner lateral surfaces 41, 42 the central body will substantially abut against the arms and prevent them from being displaced towards one another. The central body thereby forms a support body 10, 10*a* for the arms.

Figure 6:
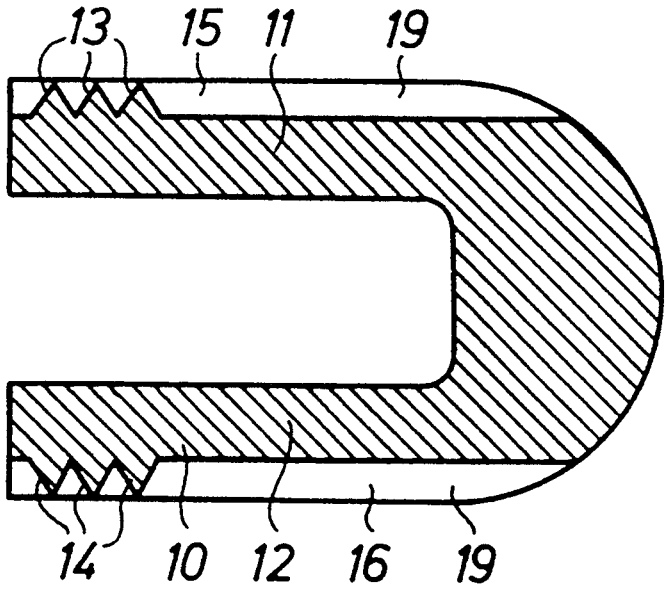
FIG. 6 is a section taken along the line A—A in FIG. 5.

In the embodiment illustrated in FIG. 6, the support body is designed somewhat like a horseshoe, the fixing devices 13, 14 being disposed on the outside of the free end portions which are formed by the first and second legs 11. 12 of the support body. As a rule, these outwardly facing surfaces are arranged substantially parallel with one another and, as a result, have an orientation, with the support body placed between both arms of the male portion, which is substantially parallel with the mutually facing defining surfaces of the arms. Hereby, the support body may be provided with the requisite number of fixing devices in order to realize a reliable retention of the support body between both arms of the male portion. As a rule, the fixing devices of the support body are disposed in a channel 15, 16. In such instance, the fixing devices 8, 29 of the male portion cooperating with the support body are disposed centrally in the defining surfaces of the male portion, whereby the defining walls of the channel 15 prevent the support body, once this has been placed between the arms of the male portion from being unintentionally displaced from its position. In one alternative embodiment, the channel is disposed in each respective inner lateral definition of the male portion.

The receiving device (the female portion) 30 has, in the illustrated embodiments, a frame-like configuration including a first frame leg 31 with a first material portion 51, and further including a second frame leg 32 with a second material portion 52. In their upper edge areas, the frame legs are mechanically interconnected, for example by means of at least one crosspiece 37, and, in their lower edge areas by means of a plate 38. There will thereby be formed, between the crosspiece and the plate, a passage 39 which is dimensioned such that at least the arms of the male portion can be inserted in through the passage. Each frame leg is, in its inner definition 35, 36 facing towards the other frame leg and in the regions of the material portion 51, 52 provided with at least one locking device (catch device) 33, 34 for cooperation with the locking device (catch device) 23, 24 of the male portion. The shape of the locking device is adapted to suit the shape of the locking device of the male portion in order to achieve the requisite locking effect in the locking devices. The locking devices of the female portion consist, for example, of recesses or bulges. The receiving device generally also includes a strap fastener 50 with one or more openings 56 through which a strap (not shown) is inserted in order to be interconnected with the receiving device.

The receiving device is also provided with a retainer plate 53 which, via spring legs 54, 55 is secured to the frame of the receiving device. The edge of the retainer plate located most proximal the strap fastener 50, has reference numeral 58, and the opposing edge of the retainer plate has reference numeral 59. The retainer plate is disposed, when compression forces are applied in a region 57 adjacent the edge 58 located most proximally the strap fastener 50, to be displaced in this region downwardly towards the plane of the strap fastener under the counteraction of the elasticity of the spring legs, the opposing edge 59 of the retainer plate being turned away from its starting position.

FIG. 1 shows the support body (the central body) 10*a* in one embodiment in which the support body is provided with gear-like fixing devices 17, 18. The support body is, in such instance, generally provided with two parallel rows of teeth 17, 18 disposed about the circumference of the support body and offset in relation to one another in the axial direction of the support body. The teeth in each respective row of teeth are, in addition, offset in relation to one another in the circumferential direction of the gear wheel so that the recesses formed between the teeth in each respective rack are located such that, in the circumferential direction of the support body, the teeth crests of the one rack are placed substantially in register with the location of the teeth troughs of the other rack. The fixing devices 28, 29 of the arms of the male portion are, in such instance, provided on each arm as two mutually offset teeth rows, whereby the support body is, once it has been placed between the arms, prevented from being displaced transversely of the axial direction of the male portion. In certain embodiments, also the mutually cooperating fixing devices 17, 18; 28, 29 of the support body with gear-wheel like design and of the arms of the male portion, respectively, are given a construction corresponding to that previously described in which the fixing devices of the support body or male portion are disposed in a channel.

Figure 3:
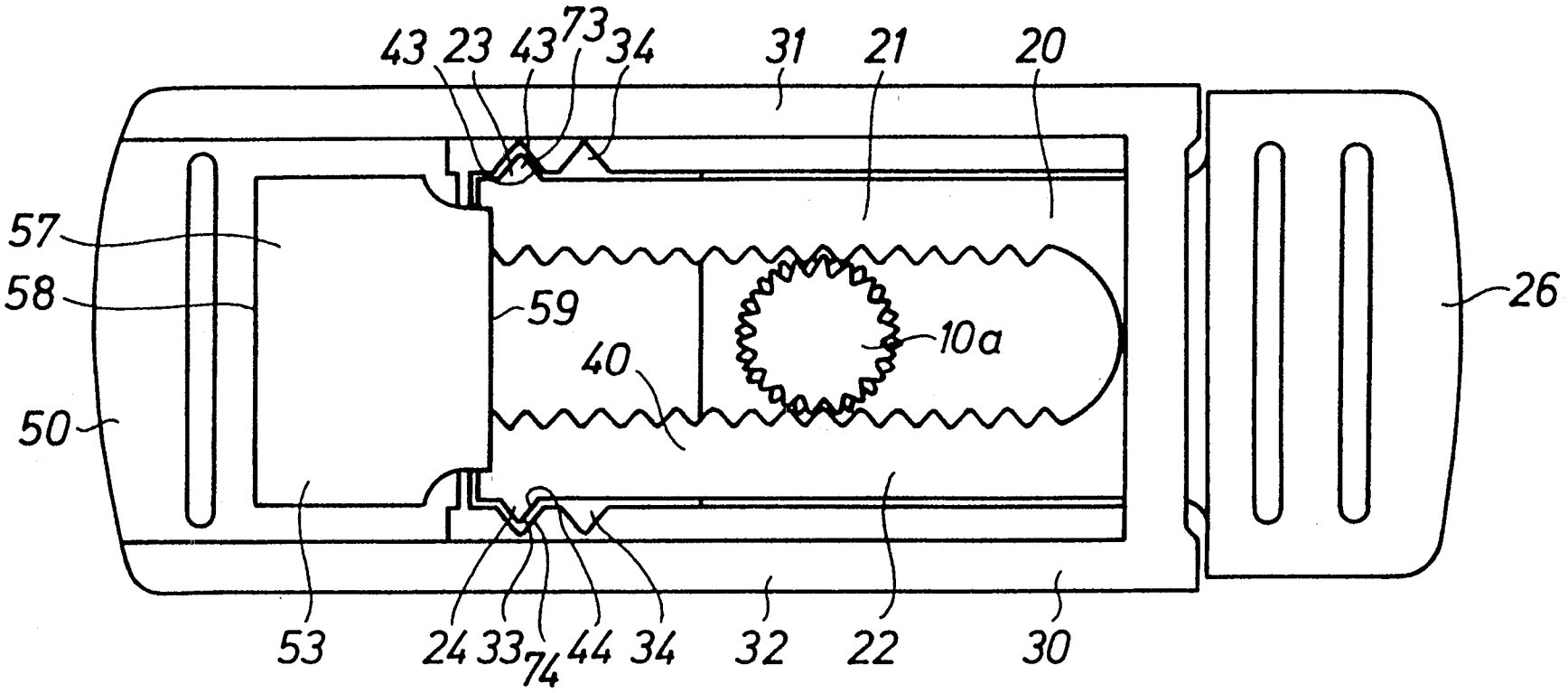
FIG. 3 is a view corresponding to that of FIG. 1 with the male portion inserted in the female portion.

With the male portion inserted in the female portion (c.f. FIG. 3), the male portion is fixed in the female portion in that the locking devices 23, 24 of the male portion have been inserted (as a rule snapped in) into one or more of the locking devices 33,34 of the female portion. The outer end areas 47, 48 of the arms 21, 22 of the male portion are located beneath the pressure plate 53 when the male portion is in the position illustrated in FIG. 3 and is prevented by the pressure plate from being rotated up out of the position in which the locking devices 23, 24 of the male portion cooperate with the locking devices 33, 34 of the female portion. On insertion of the male portion in the female portion, a pressure is applied on the pressure plate 53 in the region 57 adjacent to its strap fastener 50. In such instance, the opposing edge 59 of the pressure plate is turned away from its rest position and it becomes possible to move the free end areas 47, 48 of the arms 21, 22 of the male portion to those positions from which the locking devices of the male and female portions are moved into one another. When the pressure ceases, the pressure plate returns to the rest position, i.e. assumes that position in which the pressure plate covers the free ends of the arms and thereby prevents them from being displaced substantially at right angles to the axial direction of the male portion, i.e. substantially at right angles to the direction of those traction forces which the safety catch is disposed to be capable of withstanding until such time as these reach a predetermined magnitude.

In attempts to separate the female portion from the male portion by withdrawing the male portion from the female portion, the traction forces will be absorbed by reaction forces which act in the abutment surfaces between obliquely inclined abutment surfaces 43, 44 of the outer locking devices 23, 24 of the male portion and correspondingly inclined abutment surfaces 73, 74 of the locking devices 33, 34 of the female portion. Since the abutment surfaces are obliquely inclined, reaction forces occur with components which are directed at right angles to the direction of the traction forces. The forces directed at right angles to the traction forces act on the material in the frame legs 31, 32 and in the fork arms 21, 22 such that these are displaced from one another under the counteraction of those forces which are conditioned by the elasticity of the material. Since the arms of the male portion are not supported at their free ends, i.e. are free to be displaced towards one another under the counteraction of the elasticity in the arms, such great reaction forces will occur on an increase of the tractive force that the locking devices of the male and female portions are displaced from those positions in which they are in engagement with one another, in which event the male portion is withdrawn from the female portion. The magnitude of the requisite tractive force is determined by a large number of factors, such as the elasticity of the material, the dimensions of the arms of the male portion, the distance between the positions of the locking devices and the support points of the arms, the angle between the direction of the tractive forces and the direction of the abutment surfaces, etc. In certain embodiments, the web portion is dimensioned such that a spring force occurs therein, whereby displacement of the arms towards one another in the region of the locking devices is facilitated.

Figure 4A:
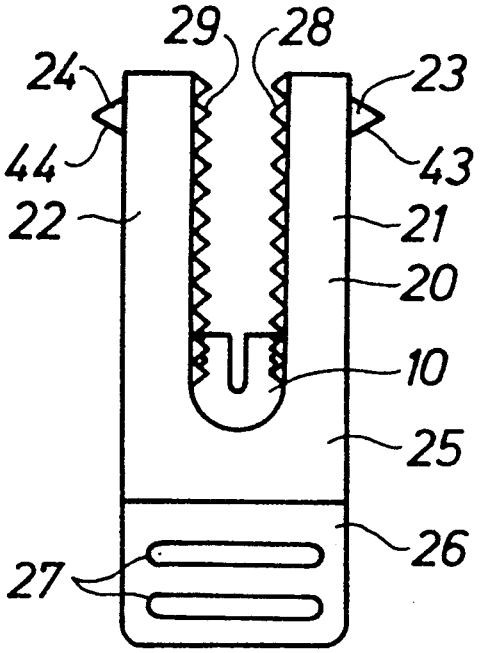
FIGS. 4*a, b* are top plan views of the male portion in one alternative embodiment.
Figure 4B:
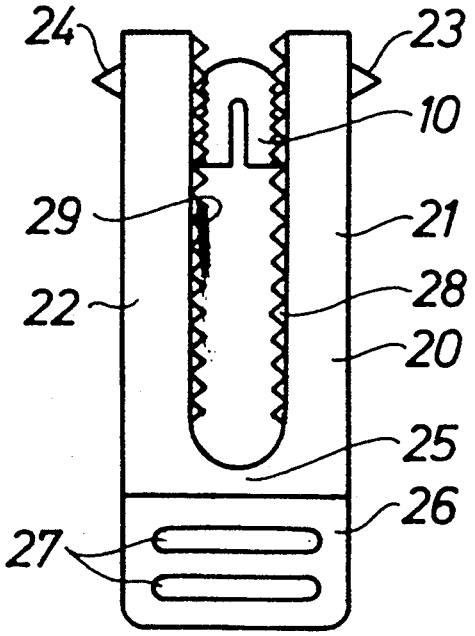
Figure 5:
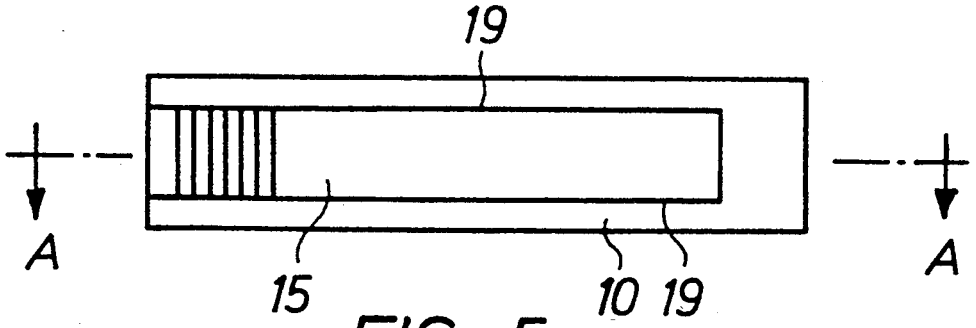
FIG. 5 shows the male portion according to FIGS. 4*a*, 4*b* seen from the side.

In embodiments which satisfy the need to adapt requisite triggering force in order to release the male and female portions from one another, use is made of the support body 10, 10*a* shown in the Figures. In such instance, this is placed in a position between the locking devices and the web portion 25 of the male portion, the position being selected such that the fulcrum which is formed from the support body to the locking devices affords the desired magnitude of the minimum tractive force at which the male and female portions are released from one another. This adjustment of the tractive force is thus achieved while retaining the design of all elements in the apparatus which are determinative of the magnitude of the triggering force. In order to increase the requisite tractive force, the support body is placed close to the position of the locking devices, and in order to reduce the requisite tractive force, it is placed close to the web portion (c.f. FIGS. 4*a* and 4*b*).

It was discussed in the foregoing how the requisite tractive force for separation of the male and female portions from one another is determined by the resilient properties of the male portion. However, it is obvious to a person skilled in the art that, in certain embodiments, also the female portion will be of such construction that its frame legs are elastically yieldable at least in the regions of the first and second material portions 31, 32 of the frame legs. This is achieved in certain embodiments in that the frame legs are interconnected in spaced apart relationship from the above-mentioned material portions, whereby the frame legs in the regions of the material portions are displaced from one another under the action of the above-disclosed reaction forces. Suitable selection of properties of the material in the frame legs, suitable dimensioning thereof and choice of those positions where the frame legs are mechanically interconnected to one another, will ensure achievement of those resilience properties of the frame legs as are required to obtain the contemplated spring return function of the frame legs.

The above detailed description has referred to but a limited number of embodiments of the present invention, but it will readily be perceived by a person skilled in the art that the present invention encompasses a large number of embodiments without departing from the spirit and scope of the appended Claims.

What is claimed is:

1. An apparatus including a male portion (20) and a female portion (30) disposed, when the male portion is inserted in the female portion, to separate the male portion from the female portion when both portions are subjected to opposingly directed traction forces exceeding a certain magnitude, said male portion (2) including a fork-like device (40) including a first arm (21), a second arm (22) and a web portion (25) interconnecting both arms in their one end regions (45, 46); said female portion (30) including a first material portion (31) and a second material portion (32) between which the fork-like device of the male portion is located when the male portion has been inserted in the female portion; both arms of the male portion and both material portions of the female portion including locking devices (23, 24; and 33, 34, respectively), which cooperate for retention of the male portion in the female portion; the locking devices of the male portion and/or the female portion being provided with abutment surfaces (43, 44; 73, 74, respectively), which are oriented at an oblique angle in relation to the direction of the tractive forces; the arms (21, 22) of the male portion and/or the material portions (31, 32) of the female portion being dimensioned so as to be under the action of forces directed substantially at right angles to the direction of the traction forces, and being resiliently yieldable to be displaced for the separation of cooperating locking devices (23, 24; 33, 34, respectively) from one another when said traction forces exceed said certain magnitude, and a support body disposed, between both arms (21, 22) of the fork-like device (40) to prevent the arms from being displaced towards one another, said support body (10, 10*a*) being adjustable to fixed positions between the web portion (25) and end areas (47, 48) of both arms located most distally from the web portion.

2. The apparatus as claimed in claim 1, wherein said support body is of wheel configuration (10*a*).

3. The apparatus as claimed in claim 1, wherein the mutually facing defining surfaces (41, 42) of the arms (21, 22) and the support body (10, 10*a*) are provided with fixing means (28, 29 and 13, 14; 17, 18, respectively) including gear and saw-tooth like recesses, which, with the support body placed between the arms (21, 22) of the fork-like device (40), fix the support body in that position in which the support body has been placed.

4. The apparatus as claimed in claim 5, wherein the locking devices (28, 29 and 13, 14; 17, 18, respectively) of the support body (10, 10*a*) and the arms (21, 22) define two parallel rows of teeth disposed along the mutually facing defining surfaces (41, 42) of the arms (21, 22) and at least along a portion of the outer surface of the support body; the teeth in each respective row of teeth in the parallel rows of the support body (10, 10*a*) and the arms (21, 22) being offset in relation to one another such that the recesses formed between the teeth in each respective tooth row are located adjacent to the teeth in the mutually adjacent tooth row.

5. The apparatus as claimed in claim 1, wherein the female portion (30) includes a resiliently supported pressure plate (53) which has a defining edge (59) defining a material region of the plate which, with the male portion (20) inserted in the female portion (30), covers the end regions (45, 46) of the arms (21, 22) of the portion located most distally from the web portion (25) of the fork-like device.

6. The apparatus as claimed in claim 1, wherein said support body has a horseshoe-like shape.

* * * * *